United States Patent [19]

Hollis

[11] 4,016,805

[45] Apr. 12, 1977

[54] METHOD FOR THE MANUFACTURE OF DUNNAGE BAG LINERS

[75] Inventor: Clinton R. Hollis, Camden, Ark.

[73] Assignee: International Paper Company, New York, N.Y.

[22] Filed: Mar. 31, 1975

[21] Appl. No.: 563,831

Related U.S. Application Data

[63] Continuation-in-part of Ser. No. 447,763, March 4, 1974, Pat. No. 3,921,506.

[52] U.S. Cl. ..... 93/35 VL; 93/8 VB; 93/33 H; 226/155

[51] Int. Cl.[2] ..... B31B 41/00

[58] Field of Search ..... 93/35 VL, 8 VB, 33 H, 93/1 WZ, 8 R, 33 R, 35 R, 14, 18, 21, 22, 26, 27; 226/155; 83/259, 262, 282

[56] References Cited

UNITED STATES PATENTS

| | | | |
|---|---|---|---|
| 2,898,995 | 8/1959 | Funnell | 83/262 X |
| 3,214,312 | 10/1965 | Gattrugeri | 93/8 VB |
| 3,244,576 | 4/1966 | Swartz | 93/8 VB X |
| 3,483,801 | 12/1969 | Kupcikevicius | 93/8 R |
| 3,802,324 | 4/1974 | Izumi et al. | 93/8 VB X |
| 3,813,998 | 6/1974 | Lotto | 93/33 H |

*Primary Examiner*—James F. Coan
*Attorney, Agent, or Firm*—Fitch, Even, Tabin & Luedeka

[57] ABSTRACT

A method and apparatus for the manufacture of inflatable liners for disposable dunnage bags. The apparatus includes means for measuring and severing an indefinite length of flattened tubular plastic material into predetermined lengths, sealing the overlying layers at one end of each severed length, and cutting an opening in the wall of the tubular material suitable for receiving an inflation valve. The method includes severing preselected lengths of tubular bag material from a supply thereof, sealing one end of each length, and cutting an opening through the bag wall to receive an inflation valve.

5 Claims, 28 Drawing Figures

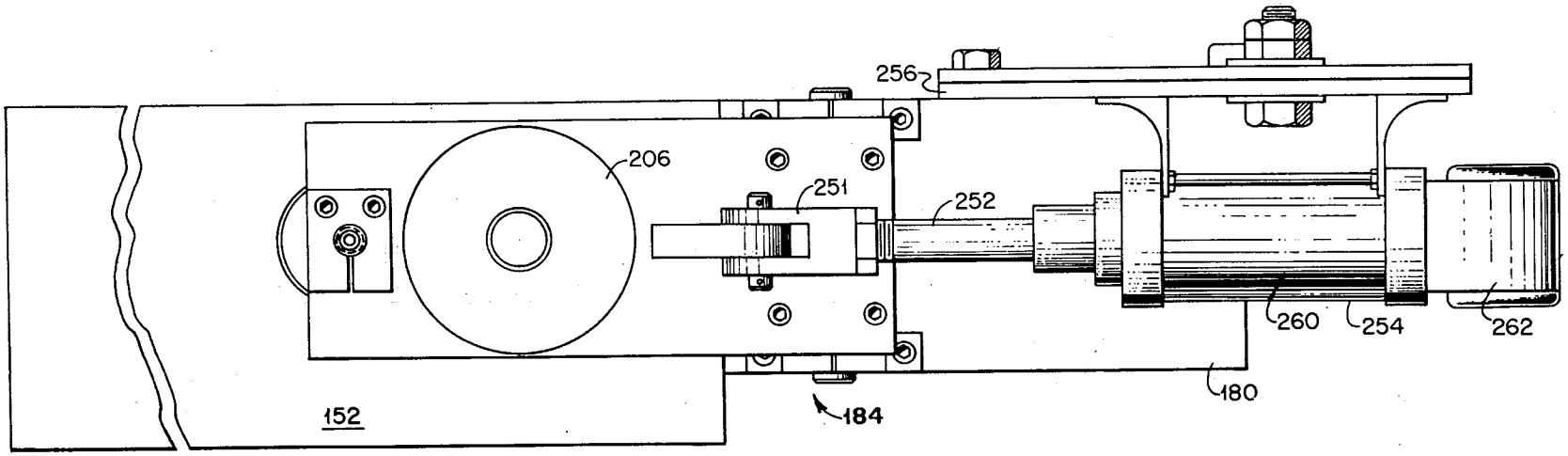
Fig. 6.
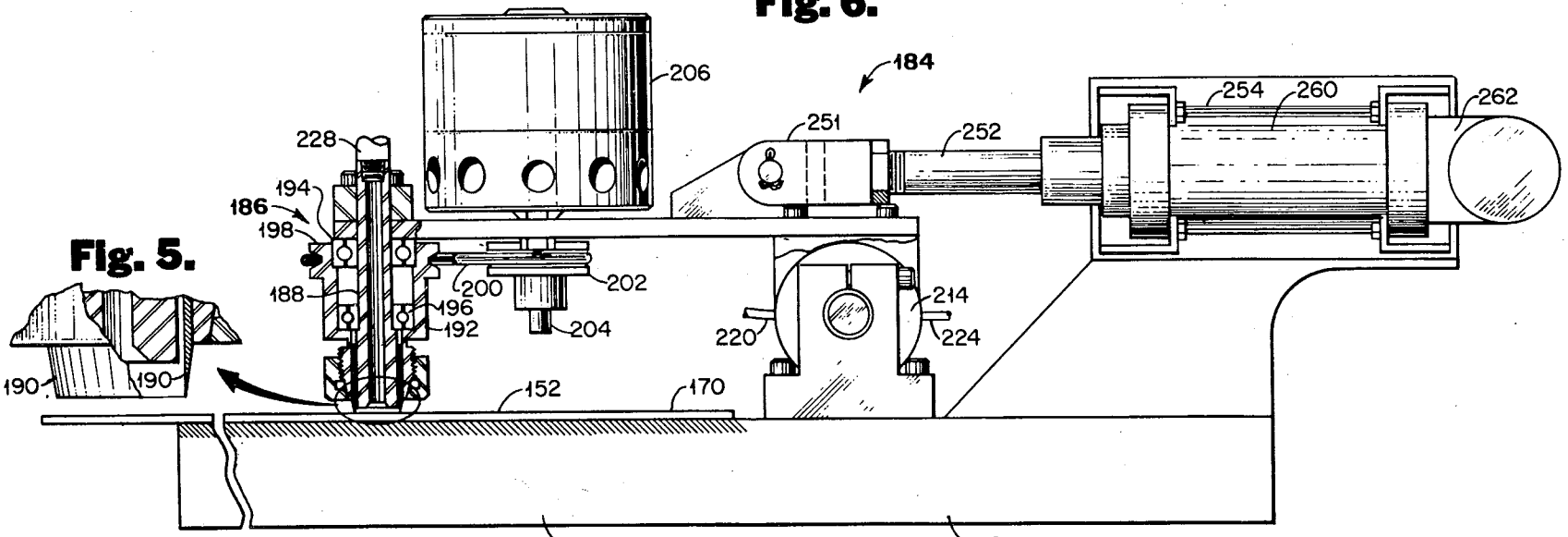
Fig. 7.
Fig. 5.

METHOD FOR THE MANUFACTURE OF DUNNAGE BAG LINERS

This application is a continuation-in-part of copending application Ser. No. 447,763, filed Mar. 4, 1974, now U.S. Pat. No. 3,921,506 for "Apparatus for the Manufacture of Dunnage Bag Liners."

This invention relates to apparatus for the manufacture of inflatable liners for disposable dunnage bags.

Dunnage bags have been used heretofore to fill the unoccupied space in an incompletely filled truck or rail car, thereby preventing shifting of the partial load during transit. Because the size of such unoccupied space is not predeterminable prior to loading the vehicle, inflatable dunnage bags have been used as a means to fully occupy whatever space within the vehicle is vacant. Preferably, the dunnage bags are not reused inasmuch as they are prone to develop tears, rips or other points of weakness which pose potential rupture points during subsequent reuse and resultant loss of control over the load. Because the bags are intended to be used once and thereafter disposed of, it is desirable that the cost of the bags be kept low.

One dunnage bag of the prior art comprises a multilayered kraft outer bag fitted with a inflatable liner or bladder disposed inside the kraft bag. To keep the cost of the dunnage bag low, the inflatable liner preferably is made from a thin-wall plastic, such as polyethylene having a wall thickness of about 4 to 6 mils. This sheet material is readily available in rolls of flattened tubing of indefinite length. Such flat sheet material comprises two flat layers overlying each other and joined to each other along their mutual side edges. When cut to suitable lengths, fitted with an inflation valve, and sealed at its ends, this material makes suitable liners for dunnage bags.

In the manufacture of a plastic liner for a dunnage bag, the thin wall of the plastic and its low friction coefficient makes it difficult to handle or manipulate, particularly when in flat sheet form. One particular problem is the tendency of the thin plastic sheet to wrinkle when it is attempted to move the sheet through an apparatus in a flat condition.

Furhter, in manufacturing dunnage bags having plastic liners, it has been found important to maintain the dimensions of the liner substantially identical to the inside dimensions of the kraft bag so that the liner fits snugly inside the kraft bag without wrinkles. When a liner is inflated, any wrinkles develop potential rupture points which could result in catastrophic failure of the bag during transit and resultant disastrous shifting of the load. Further, it is important that the inflation valve fitted in the liner be positioned precisely so that when the liner is inserted in the outer kraft bag, the valve will register with a opening in the wall of the kraft bag and the inflation valve will be exposed externally of the bag to permit subsequent inflation. In one embodiment, it is preferred that the valve be located at and project from one of the side edges of the uninflated flat bag to enhance its accessibility.

It is therefore an object of this invention to provide a method and apparatus for the manufacture of an inflatable liner for a dunnage bag. It is another object of this invention to provide a method and apparatus for the manufacture of a dunnage bag liner which is flat, rectangular, of precise length and width dimensions, and for providing a precisely located opening in the wall of the liner for receipt of an inflation valve. Other objects and advantages will be apparent from the following description, including the drawings, in which:

FIG. 1 is a representation of apparatus including various features of the invention;

FIG. 1*a* is a representation of a product produced by the apparatus of FIG. 1;

FIG. 2 is an elevation view of the left side of the apparatus depicted in FIG. 1;

FIG. 2*a* is a fragmentary representation of a sheet material movement monitoring device;

FIG. 5 is a sectional view taken generally along the line 5—5;

FIGS. 6 and 7 are side elevation and plan view, respectively, of FIG. 4, of one embodiment of a hole cutter device as disclosed herein;

Figure 1:
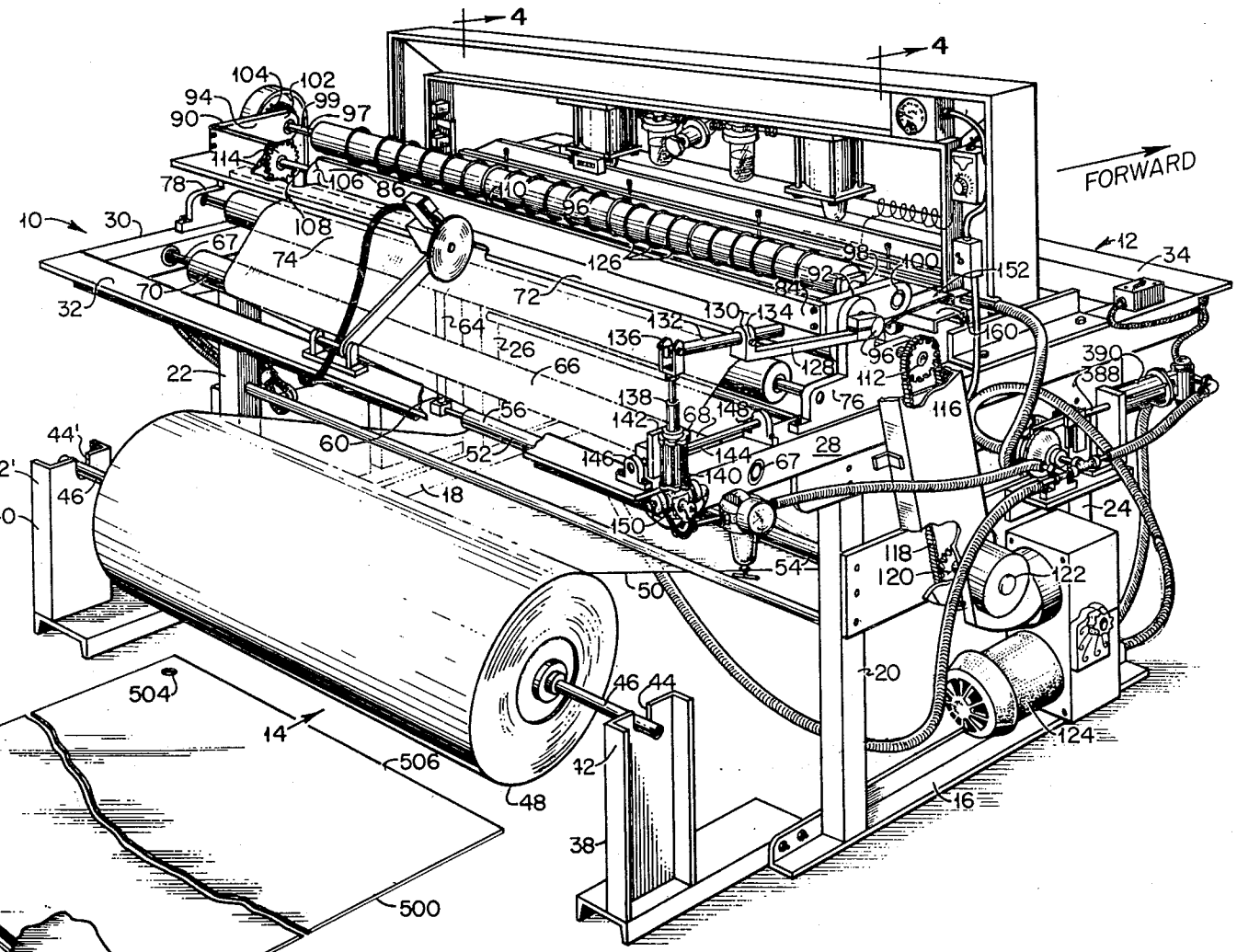
Figure 9:
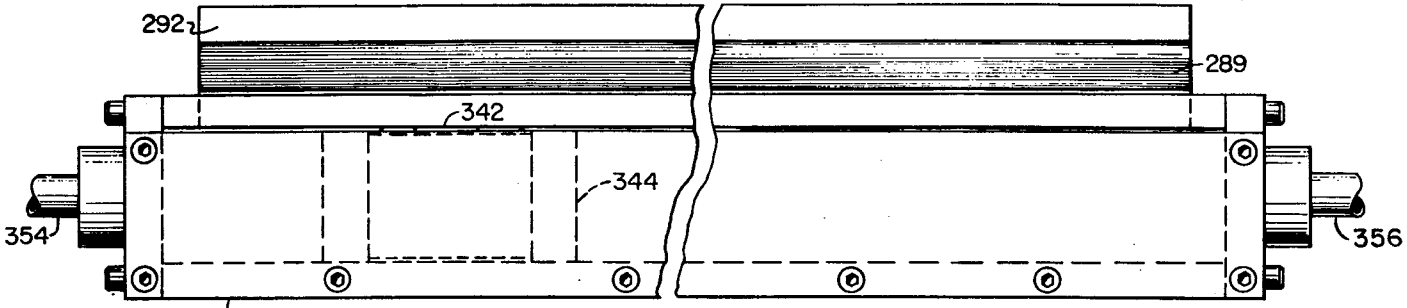
FIGS. 8 and 9 are side elevation views, with one side plate removed, and a plan view, respectively, of a cutoff knife device as disclosed herein.
Figure 8:
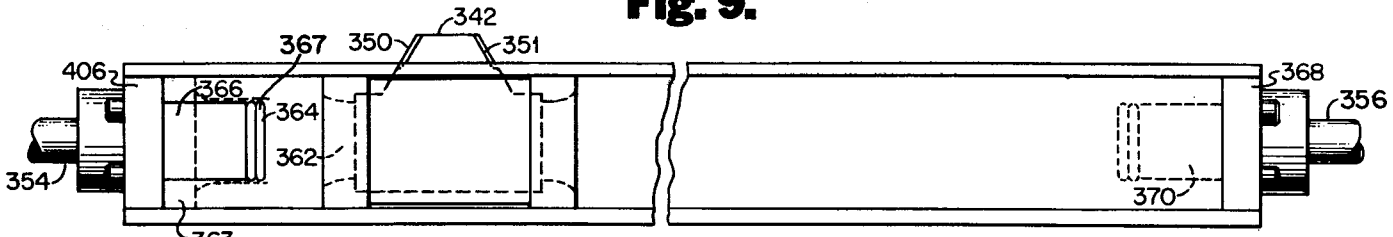
Figure 13:
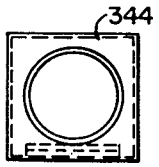
FIGS. 11, 12 and 13 are side elevation, plan, and end views, respectively, of a block for holding a cutoff knife.
Figure 12:
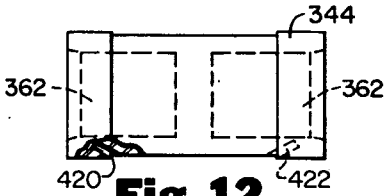
Figure 11:
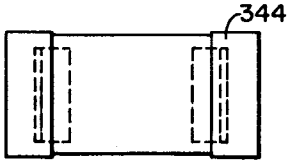
Figure 10:
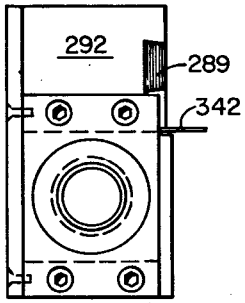
FIG. 10 is an end elevation view of the left end of the device depicted in FIG. 8.
Figure 15:
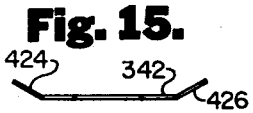
FIGS. 14 and 15 are side and top views, respectively, of a cutoff knife.
Figure 14:
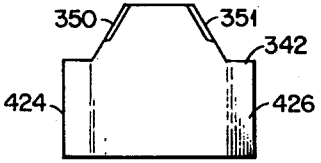
Figure 22:
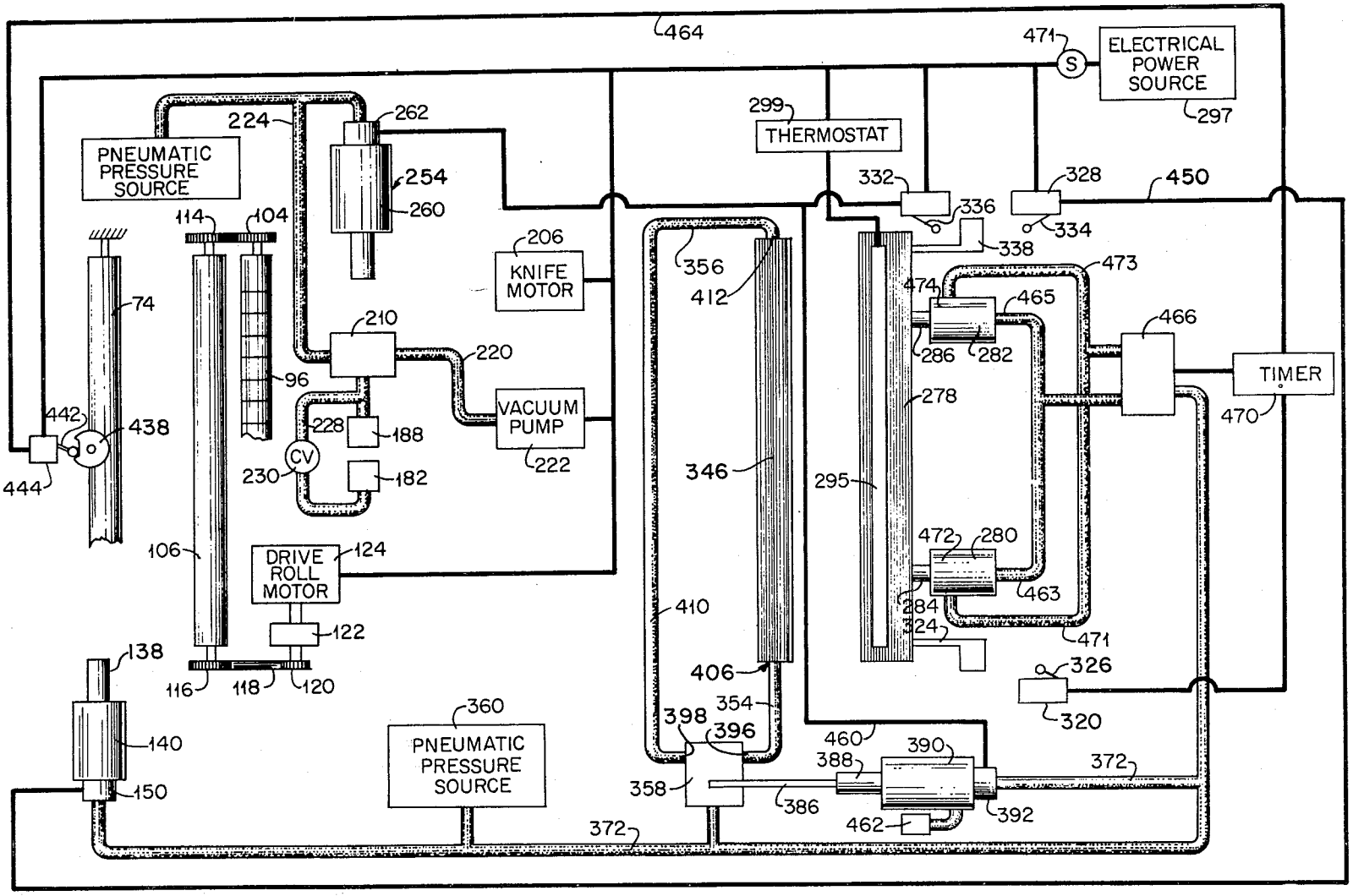
Figure 23:
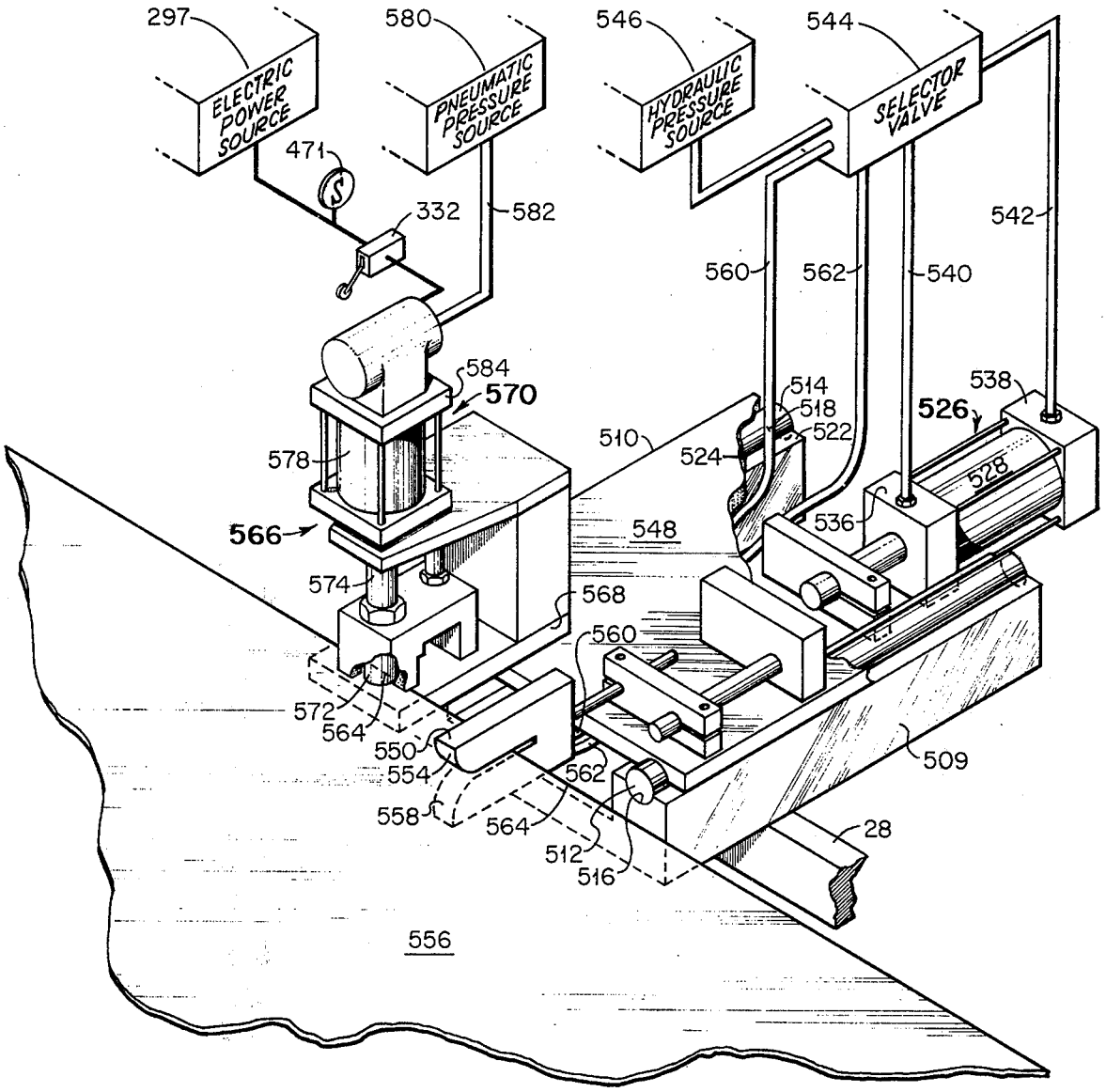

FIGS. 17, 17*a*, 18, 18*a*, 19, 19*a*, 20 and 21 depict a rotary valve employed in controlling the functioning of the the cutoff knife depicted in FIGS. 8 and 9;

FIG. 22 is a schematic representation of a control system, showing pneumatic and electrical features, for the apparatus depicted in FIG. 1; and FIG. 23 is a representation of apparatus suitable for cutting a hole in the side edge of a folded bag material.

The disclosed apparatus includes means for storing and dispensing a supply of flattened tubular shedt material, means for feeding the sheet material in a flat condition forwardly from the storage means, means for monitoring the forward movement of the sheet and stopping such forward movement at predetermined intervals, means for severing the sheet material across its width when it is stopped, means for sealing one end of each severed section of tubular sheet material, and means for cutting an opening through one of the layers of the sheet material at a location adjacent the unsealed end of each severed section.

In accordance with the method, a continuous length of air-impervious tubular material flattened into sheet form is stored in position for dispensing in a forward direction.

The leading end of said material is disposed in the nip between a pair of feed rolls, at least one of which is movable between positions of pressure engagement and disengagement with the material in the nip, following which the movable roll is moved into pressure engagement with the material in the nip, and at least one of the feed rolls is rotated to move the material forwardly to a cut-off station where it is disposed proximate to a knife means.

The material is supported transverse to its forward movement at a location between its storage location and the feed rolls in engagement with an elongated surface and below an elongated friction means aligned with the elongated surface and which is movable between positions of pressure engagement and disengagement with the material on the elongated surface.

After a predetermined length of the material has moved past the cut-off station, the movable feed roll is moved toward its position of disengagement with the material, and the movable friction means is moved toward its position of engagement with the material to stop the forward movement thereof. Substantially simultaneously, the material is clamped between opposed surfaces along elongated spaced apart locations on opposite sides of the knife means, each of the locations extending transversely of the forward direction of movement of the material, and thereafter the material is severed fully across its dimension transverse to its direction of forward movement.

The trailing end of the severed length of material is sealed along a line extending fully across the material transversely of its direction of forward movement. In the preferred method, a hole is opened through the wall of the product to receive an inflation valve.

In the depicted embodiment, the apparatus includes frame means 10 having forward and rear ends 12 and 14 respectively. The sides of the frame include base members 16 and 18, vertical members 20, 22, 24, 26, and side members 28 and 30. The opposite sides of the frame are joined to each other as by horizontal cross members 32, 34 and 36.

A pair of upright standards 38 and 40 are mounted on opposite sides of the rear end 14 of the frame base members 16 and 18. The top end 42 of each standard is provided with a slot 44 defining a support for the spindle shaft 46 of a supply roll 48 of flattened tubular sheet material 50 disposed in a horizontal position and extending across the width of the frame in position to be passed through the apparatus.

A dancer roll 52, journaled at its opposite ends 54 and 56 in the outboard ends 58 and 60 of a pair of arms 62 and 64 which are hingedly connected to the horizontal frame members 28 and 30, extends across the width of the frame 10. In this manner the dancer roll 52 is free to move in a generally arcuate path about the hinge axis of the arms 62 and 64 and, by virtue of its weight, to maintain a downward pressure against the sheet material 50 when such sheet material is wrapped about the dancer roll as appears more fully hereinafter.

Above the dancer roll and rearwardly thereof there is provided an idler roll 66 including a shaft 67 rotatably mounted at its opposite ends 68 and 70 to the horizontal frame members 28 and 30 so that it extends across the width of the frame.

Above and forwardly of the idler roll 66, there is provided a braking means comprising a brake roll 74 whose opposite ends are journaled in upright standards 76 and 78 that are secured to the horizontal frame members 28 and 30, respectively. The braking means further includes an elongated brake beam 72 which also extends across the width of the frame and substantially parallel to the brake roll 74. This beam 72 includes a flat face 80 disposed above and in juxtaposition to the brake roll 74, the face 80 having mounted thereon a strip of friction material 82 facing the brake roll 74. The opposite ends 84 and 86 of the beam 72 are secured to the ends 88 and 90, respectively, of rocker arms 92 and 94 pivotally mounted by shafts 95 and 98 to the upright standards 76 and 78. As thus mounted, the beam 72, hence the friction strip 82, is movable toward and away from the brake roll 74 upon movement of the rocker arms 92 and 94.

A set of drive rolls is mounted on the frame at a location forwardly of the brake means, each of the rollers of the set being disposed horizontally across the frame. This set of drive rolls includes a friction drive roll 96 having a shaft 97 extending from opposite ends thereof and journaled at one end 99 in one end 100 of the rocker arm 92. The shaft 97 is further journaled at its opposite end in the end 102 of the rocker arm 94 so that the friction drive roll 96 is translatable along a generally vertical path in response to rocking movement of the rocker arms 92 and 94. The end 99 of the shaft 97 is further provided with a spur gear 104 fixedly mounted thereon.

The set of drive rolls further includes a smooth surface drive roll 106 having a shaft 108 extending from the opposite ends thereof, such roll being oriented substantially parallel to the friction drive roll 96 and in juxtaposition thereto to define a nip 110 therebetween. One end of the shaft 108 is journaled in the upright standard 76, with the opposite end of the shaft 108 being journaled in the upright standard 78 disposed on the opposite side of the frame. The end of the shaft 108 entends laterally beyond its journaled mounting in the standard 78 and is provided with a spur gear 114 fixedly secured thereon. This gear 114 on shaft 108 is substantially identical in size to the gear 104 on the shaft 97 and meshes therewith so that the shafts turn simultaneously and in opposite direction when the gears 114 and 104 are rotated. The opposite end of the shaft 108 is provided with a further spur gear 116 which is drivingly connected by a drive chain 118 to a gear 120 on the output shaft (not visible) of a gear reducer 122 connected to a motor 124 such that operation of the motor functions to rotate the friction drive roll and the smooth surface drive roll in unison. In the preferred embodiment, the motor 124 operates continuously while the apparatus is functioning thereby continuously rotating the drive rolls. The limit of rocking movement of the rocker arms 92 and 94 which raises the friction drive roll 96 away from the drive roll 106 is less than that which will allow the gears 114 and 104 to move out of driving engagement therebetween so that when the friction drive roll 96 is raised, it continues to rotate.

Preferably the friction drive roll 96 is provided with a plurality of resilient circumferential friction rings 126 spaced apart substantially equal distances from each other along the length of the friction drive roll 96. As depicted, each of the rings 126 preferably resides in a circumferential groove in the circumference of the roll 96 to aid in maintaining the relative spacing between the rings. The circumference of the friction roll 96 is chosen to be less than the circumference of the drive roll 106 by an amount such that when the rolls frictionally engage the sheet material between them and the resilient rings 126 are compressed, the circumference of the rings, as compressed, substantially equals the circumference of the drive roll 106 thereby providing for substantially equal tangential speeds of those surfaces of these two rolls that engage the sheet material. In this manner, the driving forces imparted to the top and bottom layers of the flattened tubular sheet material are substantially equal and the sheets are moved forwardly simultaneously. This structure and the use of multiple spaced apart friction rings has been found effective in preventing wrinkles in the bilayered sheet material when driving it forwardly through the apparatus. Further, the friction rings function to align the length dimension of the sheet material with the desired forward direction of travel through the apparatus.

Movement of the brake beam 72 and the friction drive roll 96 between their respective positions of engagement and disengagement with the sheet material fed through the apparatus is effected simultaneously by mounting these two elements on opposite ends of the rocker arms 92 and 94. It is noted that when the brake beam is in its position of engagement, the friction drive roll is in its position of disengagement and vice versa. To effect movement of the rocker arms, the shaft 95 of the rocker arm 92 has fixedly secured thereto an elongated arm 128 that extends rearwardly from the shaft 95 and along the side of the frame 10. The rear end 130 of the arm 128 is upturned and provided with an opening through which there is slidably received a rod 132. A set screw 134 is provided to secure the rod 132 in a chosen position within the opening. The rear end of the rod 132 is pivotally connected to a clevis 136 mounted on the end of a piston 138 of a piston-cylinder 140 that is mounted on a plate 142 which is slidably received on a rail 144 whose opposite ends are mounted in blocks 146 and 148 secured to the frame member 28. In this manner, the relative positions of the piston-cylinder 140, the rod 132 and the arm 128, are adjustable to select the distance between the shaft 95 and the piston 138 and thereby set the limits of rotation of the shaft 95 by vertical movement of the piston 138, hence set the limits of the rocking movements of the rocker arms 92 and 94 to establish the desired positions of the brake beam 72 and the friction drive roll 96 relative to the brake roll 74 and the drive roll 106, respectively. The depicted piston-cylinder 140 is single acting with its piston 138 spring-biased toward its retracted position. Admission of pneumatic pressure to the piston-cylinder 140 and exhausting the same is effected by a solenoid valve 150 interposed between the piston-cylinder 140 and a source of pneumatic pressure (See FIG. 22).

A generally planar apron 152 is disposed across the frame in a generally horizontal plane with its leading edge 154 disposed adjacent the nip 110 between the drive rolls 96 and 106. The apron 152 extends from the nip of the drive rolls forwardly to define a flat smooth surface 156. Preferably the leading edge 154 of the apron is inclined downwardly to guide the sheet material from the nip 110 onto the top surface 156 of the apron.

In the depicted embodiment the apron 152 is mounted on a slide beam 160 comprising an inverted U beam having depending longitudinal sides 162 and 164 extending along its length. One of the sides 162 is mounted in the circumferential groove of a pulley 166 that is rotatably mounted on the end of a shaft 165 mounted in the frame cross member 36. The other longitudinal depending side 164 of the beam 160 is slidably received on a rail 163 disposed on the upper surface 168 of the frame cross member 36, thereby slidably mounting the beam for movement in a direction transverse to the frame length.

Figure 3:
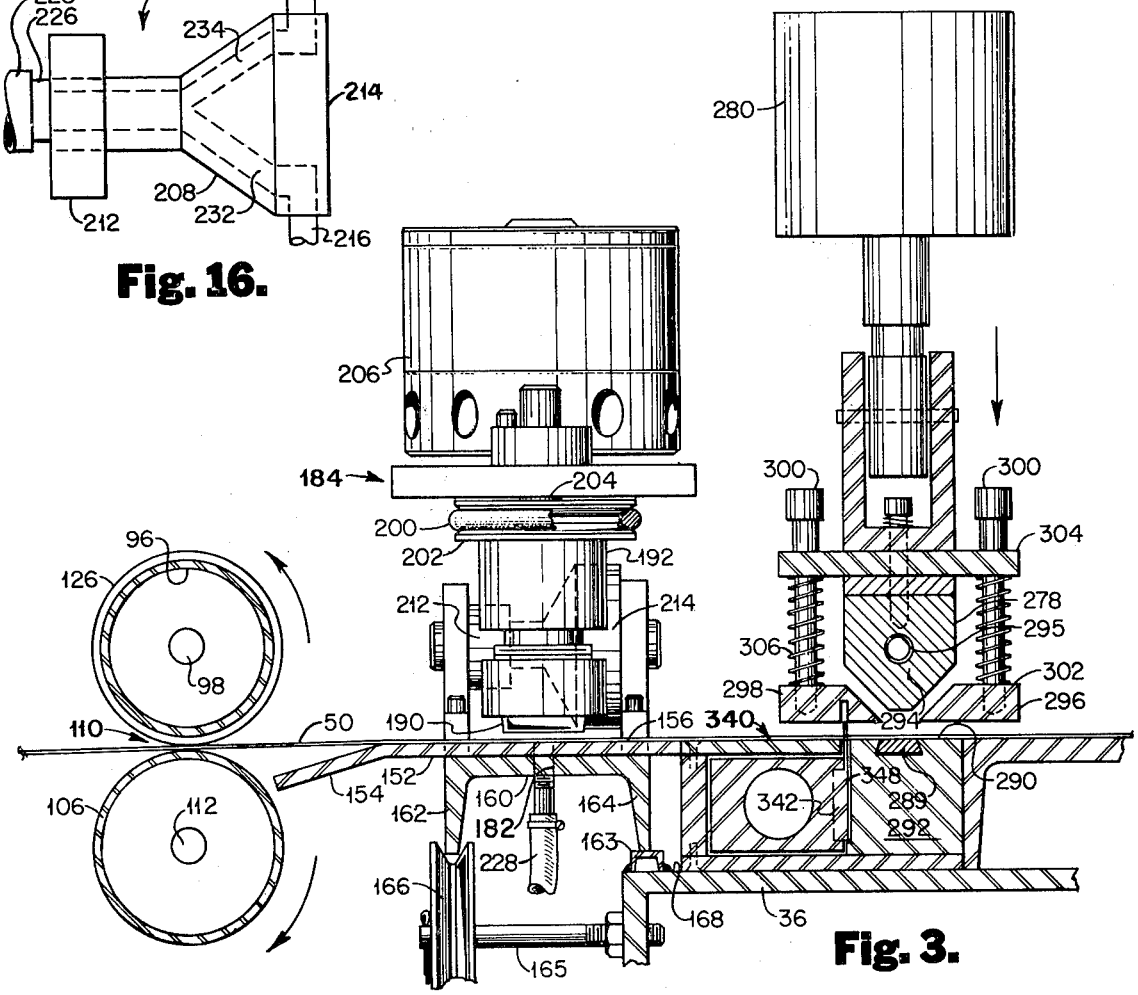
FIG. 3 is a fragmentary sectional view, partly schematic of sealing and cutting portions of the disclosed apparatus, including the drive rolls.

Adjacent one end 180 of the beam 160 there is provided an opening 182 extending through the thickness of the beam and the overlying apron to define a vacuum port for the application of suction to the upper surface 170 of the apron. Further, on the end 180 of the beam 160 there is mounted a hole cutter 184 adapted to cut a circular opening in the top layer of the bilayered sheet material. As depicted in FIGS. 3, 6 and 7, the hole cutter 184 comprises a cutting head 186 including a hollow tubular knife 188, having one of its ends sharpened to define a circular cutting edge 190, rotatably mounted in a housing 192 as by means of bearings 194 and 196. The end of the knife 188 opposite the cutting end is provided with a sheave 198 fixed thereto and drivingly connected by a belt 200 to a sheave 202 fixed on the shaft 204 of a motor 206. When the apparatus is in operation, the motor 206 runs continuously so that the cutting knife is rotating at all times.

The housing 192 holding the knife 188 is pivotally mounted on a shaft which forms a rotating member 208 of a rotary valve 210. The shaft is rotatably mounted at its opposite ends in a pair of blocks 212 and 214 that are secured to the top 170 of the beam 160. In this manner the housing 192 is adapted to be moved such that the cutting head 186 moves along an arcuate path toward and away from the sheet material disposed on the top of the apron 152. One of the blocks 214 defines a stationary member of the rotary valve 210. This stationary member is provided with two inlets 216 and 218, one of which is connected by a conduit 220 to a vacuum pump 222 and the other of which is connected by a conduit 224 to a source of pneumatic pressure. The rotating member 208 of the rotary valve 210 is provided with an outlet 226 which is connected by means of a conduit 228 to the top end of the hollow knife 188 and to the bottom vacuum port 182 so that suction applied through the outlet 216 exerts its influence at the cutting edge of the rotary knife and at the bottom vacuum port. A check valve 230 is interposed in the conduit 228 to prevent the passage of pressurized air to the bottom vacuum port 182.

The rotary member 208 of the rotary valve 210 is provided with openings 232 and 234 therethrough at locations such that when the cutting knife is lowered to a position adjacent the sheet material, the opening 232 in the rotating member is aligned with the vacuum inlet 216 of the stationary member of the rotary valve thereby applying suction through the rotary valve and conduit 228 to the top and bottom layers of the sheet material. Upon movement of the cutting head away from the sheet material, the opening 232 in the rotating member 208 moves out of register with the vacuum inlet 216 thereby cutting off the vacuum and releasing the sheet material. As the cutting head 186 is further rotated, the opening 234 in the rotating member 208 comes into register with the pressure inlet 218 of the stationary member to admit pressurized air to the top end of the rotary knife 188 to blow the circular plug cut from the sheet material out of the rotary knife. Further upward movement of the cutting head moves the opening 234 out of register with the pressure inlet 218 to halt the flow of pressurized air throught the rotary knife.

The housing 192 is further connected by a clevis 251 to the end of a piston 252 of a piston-cylinder 254, the latter being mounted on an upstanding plate 256 secured to the side 162 of the beam 160 so that the hole cutter 184 is movable with the beam 160 in a direction transverse to the direction of forward movement of the sheet material through the apparatus. This freedom of movement of the hole cutter provides lateral adjustment of the cutting head relative to the edge 258 of the sheet material moving through the apparatus so that the location of the hole cut in the top layer of the sheet material will be located an exact distance inwardly of the sheet material from its edge 258. Lateral freedom of movement of the hole cutter is made necessary by reason of the uneveness commonly found in the edges of a wound roll of sheet material. Being movable, the hole cutter may be moved in and out to follow the variable position of the edge 258 of the sheet material as the sheet material is moved through the apparatus. Such movement of the hole cutter may be effected manually or, if desired, provision may be made for automatically sensing the position of the edge of the sheet material and developing a signal to drive the beam 160, hence the hole cutter 184, in and out as required to follow the edge 258.

The cylinder 260 of the piston-cylinder 254 is connected through a solenoid valve 262 to a source of pneumatic pressure. Upon opening of the solenoid valve 262, and resultant extension of the piston 252, the housing 192 is pivoted to lower the cutting head 186 to a position immediately above the sheet material. Upon closing of the valve 262, the piston moves to its spring-biased retracted position to raise the cutting head 186 away from the sheet material.

Downstream from the hole cutter means there is provided a heat sealing means 263 extending across the frame 10 comprising a horizontal support beam 272 mounted at its opposite ends on the frame 10 by means of upright standards 274 and 276. An elongated heat seal bar 278, having a length at least equal to the width of the sheet material being processed, is connected to the beam 272 by means of a pair of double-acting piston-cylinders 280 and 282 which depend from the beam 272. The piston members 284 and 286 of the piston-cylinder units 280 and 282 are connected to the heat seal bar 278 at separated locations so that extension and retraction of the pistons 284 and 286 serves to lower and raise the heat bar relative to an elongated anvil member 289 disposed in top surface 290 of a bar 292 disposed across the frame 10 beneath the seal bar 278. The seal bar 278 is of relatively narrow width and heated by means of a heater 295 inserted in the bottom edge 294 of the bar and extending along its length to provide substantially uniform heating of the bottom edge 294 of the bar. Electrical power for operating the heater 295 is fed from a source 297 of such power through a thermostat 299 to the heater.

The bar 278 is flanked on its opposite sides by clamp members 296 and 298, one of which is spring mounted on each of the opposite sides of the heat seal bar as by bolts 300 threadably received in the top surface 302 of each clamp member 296 and extending upwardly therefrom to be slidably received in a ledge 304 extending horizontally from the side of the heat seal bar. Each of the clamps 296 and 298 is of substantially the same length as the heat seal bar 278 and extends substantially parallel therewith across the frame 10. Spring means 306 is provided on each of the bolts 300 such that when the several springs are relaxed, the clamps 296 and 298 depend below the vertical level of the bottom edge 294 of the bar 278. Upon movement of the bar into contact with the anvil member 289 disposed below the bar, the clamps are moved into alignment with the bottom of the seal bar, thereby expanding the springs 306 and biasing the clamps against the top surfaces of the bar 292 and the channel 340.

A first switch means 320 is mounted on the upright standard 276 at a location above and adjacent one end 322 of the heat seal bar 278. A first contact arm 324 mounted on the end of the heat seal bar engages a switch arm 326 of the first switch means 320 upon movement of the heat seal bar to its upper position. A second switch means 328 is mounted on the upright standard 274 at a location above and adjacent the opposite end 330 of the heat seal bar 278. A third switch means 332 is also mounted on the upright standard 274 at a location above the heat seal bar, but below the second switch means 328. Each of the second and third switch means includes a switch arm 334 and 336, respectively. A contact arm 338 on the end 330 of the heat seal bar 278 is provided to engage the switch arm 336 of the third switch means 332 when the heat seal bar is in its lower position.

A cut-off knife 340 for severing the sheet material across its width is mounted on the frame 10 at a location adjacent to and rearwardly of the heat seal bar 278. This cut-off knife comprises a double edged blade 342 secured to a slide block 344 which is slidably contained in a tubular channel 346 that extends across the frame 10 at a location rearwardly of the heat seal bar. The channel 346 is provided with a slot opening 348 through which the cutting edges 350 and 351 of the blade project to present the double cutting edge at a vertical level above the top 352 of the channel 346. As seen in FIG. 3, the slot 348 is located rearwardly of the seal bar 278 and forwardly of the clamp 298 so that when the seal bar and its clamps are lowered into engagement with the sheet material, the sheet material is securely held for the knife to make a cut across the width of the sheet material. Notably, this cut is made immediately rearwardly of the seal made by the seal bar 278 so that the forward cut edge of the sheet material defines one end 502 of the liner 500.

The slide block 344, hence the blade 342, is moved along the length of the channel 346 preferably by pneumatic pressure. To this end, the channel 346 has connected to the opposite ends thereof conduits 354 and 356 that lead through a rotary valve 358 to a source 360 of pneumatic pressure. The block 344 is preferably of light weight construction, hence has substantial portions thereof cut away. In the preferred embodiment, each end of the block is provided with a closed bore 362 adapted to receive therein a hollow tubular piston member 364 mounted at the end of the channel 346 in horizontal alignment with the axis of the bore 362. It will be recognized that when the block 344 moves into engagement with the piston 364, as shown by the dotted line position of the block 344 in FIG. 8, air is trapped in the annular space 363 between the outer wall of the piston 364 and the inner wall of the channel 346 and compressed to exert a braking effect upon the moving block. Preferably the piston member 366 is provided with an O-ring 366 encircling the piston adjacent its outboard end to insure adequate entrapment of air within the annular space 363. The opposite end 368 of the channel 346 is provided with a like piston member 370 which functions to brake the block when it is moved in a direction toward the end 368 of the channel.

As visualized from FIG. 8, when the hollow piston 364 resides in the bore 362 of the block 344, pneumatic pressure admitted through the conduit 354 is initially captured in the bore 362 and effective against the bottom of the bore to impart a force against the block sufficient to propel it rapidly along the length of the channel 346.

Figure 21:
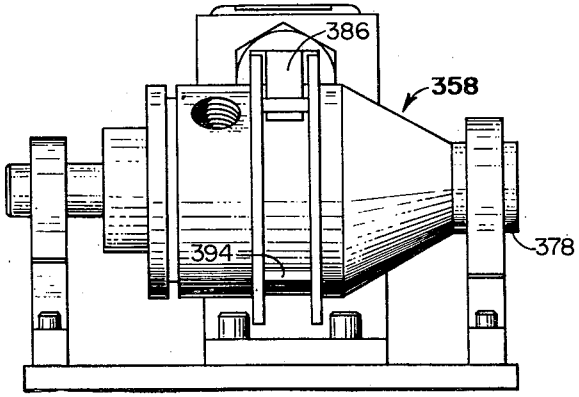
Figure 20:
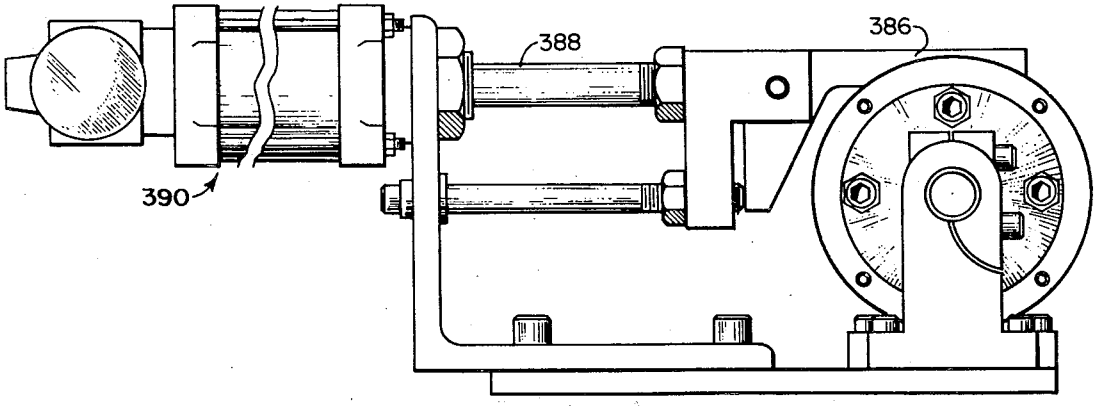
Figures 19, 19A:
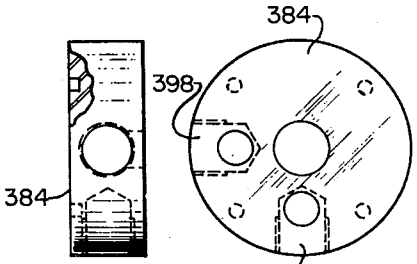
Figure 18A:
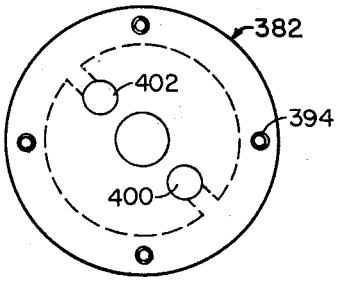
Figure 18:
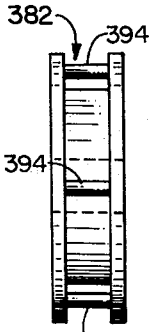
Figure 17:
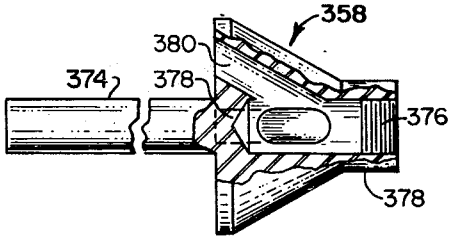
Figure 17A:
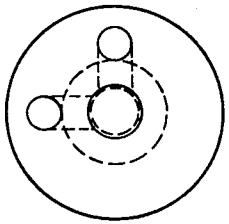

Referring to FIGS. 21 and 22, the rotary valve 358 which controls the admission of pneumatic pressure to the ends of the channel 346 is connected by means of a conduit 372 to a source of pneumatic pressure 360. The depicted rotary valve comprises an inlet member 374 having an internal bore 376 divided at one end of the member into two legs 378 and 380 which open inwardly of the valve. A central rotating member 382 is disposed between the inlet member 374 and a stationary outlet member 384 of the rotary valve. This central rotating member is adapted to be rotated about its axis by means of a pawl 386 attached to the piston 388 of a piston cylinder 390 whose actuation is controlled by a solenoid valve 392. The pawl 386 engages cross rods 394 on the central rotating member 382 when the pawl is extended by the piston 388. By design, each full extension of the piston 388 results in rotation of the rotary member 382 by one-quarter turn.

The valve 392 controlling the piston-cylinder 390 is connected by lead 322 to the switch 332 so that the electrical signal developed by this switch when the seal bar 278 is lowered causes the valve 392 to open and admit pneumatic pressure to the piston-cylinder 390, extend the pawl 386 and rotate the central rotating member 382 of the rotary valve. Further, when the seal bar 278 is raised, the signal from the switch 332 causes the valve 392 to close, exhaust the pneumatic pressure and allow the piston 388 to retract the pawl 386 under the influence of a spring bias provided in the piston-cylinder 390.

The stationary outlet member 384 of the rotary valve 358 is provided with openings 396 and 398 which register with openings 400 and 402 leading through the central rotary member 382 in preselected sequence, depending upon the rotational position of the central rotary member 382, alternately admitting pressurized air from the inlet member 374, through the central rotary member 382 to one of the outlets 396 and 398 of the outlet member 384. The outlet 396 of the valve outlet member 384 is connected by conduit 354 to one end 406 of the channel 346. The other of the outlets 398 is connected by a conduit 356 to the opposite end 412 of the channel 346 so that pressurized air for propelling the knife block 344 along the channel 346 is admitted first to one end of the channel to propel the knife along the length of the channel and perform a cut of the sheet material across its width, and thereafter is admitted to the other end of the channel to reverse the direction of travel of the knife and thereby effect a cut of the sheet material in such reverse direction. By this means the knife is made to cut in both of its directions of travel.

The cutting blade 342 preferably is formed of relatively thin metal having a substantial spring constant. The depicted blade is substantially rectangular except that one long side has double tapered edges 350 and 351, each of which is sharpened to define a cutting edge, so that the blade is capable of cutting when moved in either direction across the width of the frame 10. To mount the blade in the block 344, the block is provided with two parallel vertical slots 420 and 422 on one side of the block. These slots are spaced apart by a distance slightly less than the length of the blade 342. The blade is attached to the block by bending the blade, inserting its opposite ends 424 and 426 in the slots 420 and 422 and releasing the bending moment of the blade so that the blade springs back to hold itself in the slot.

Figure 2:
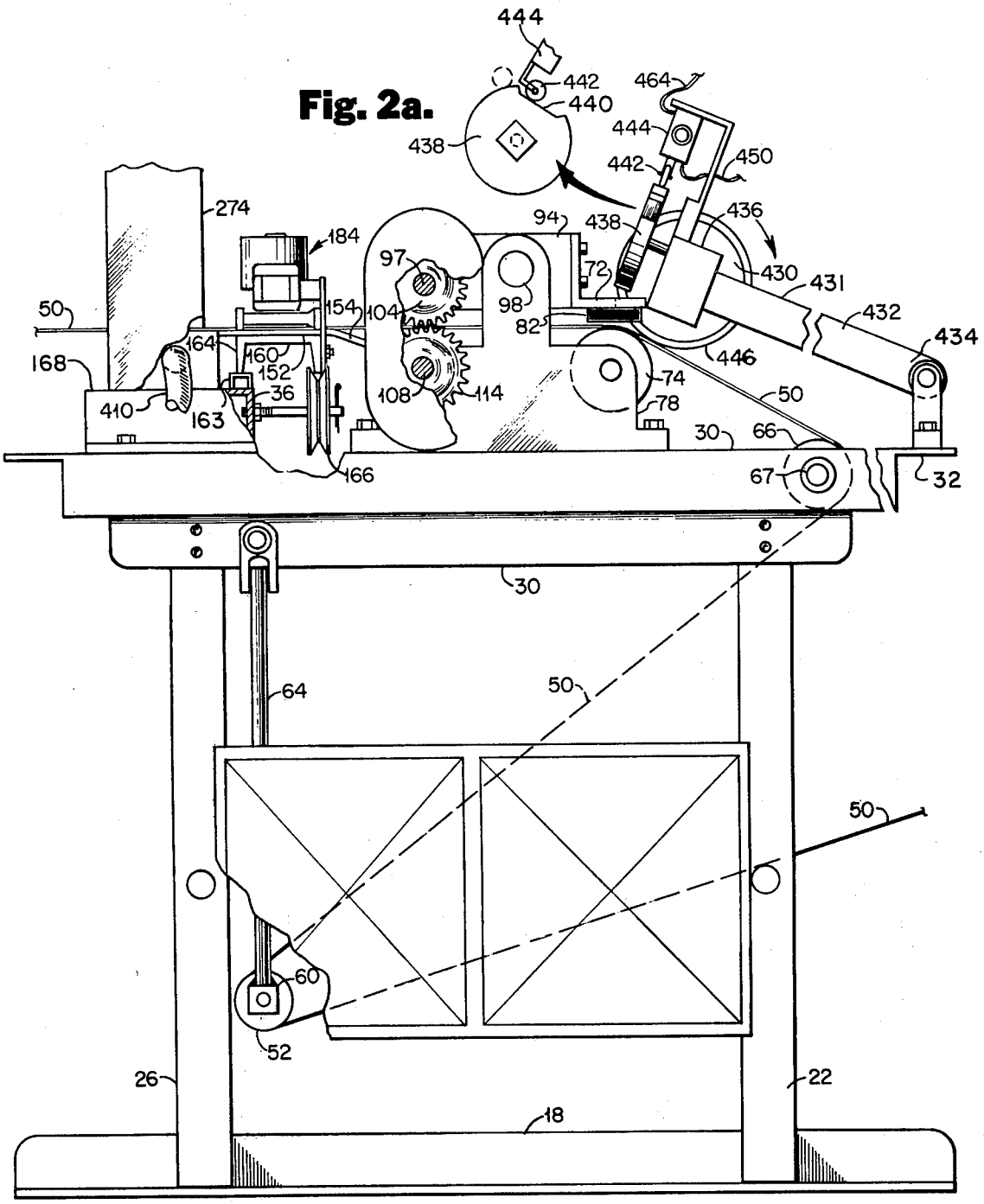
Figure 4:
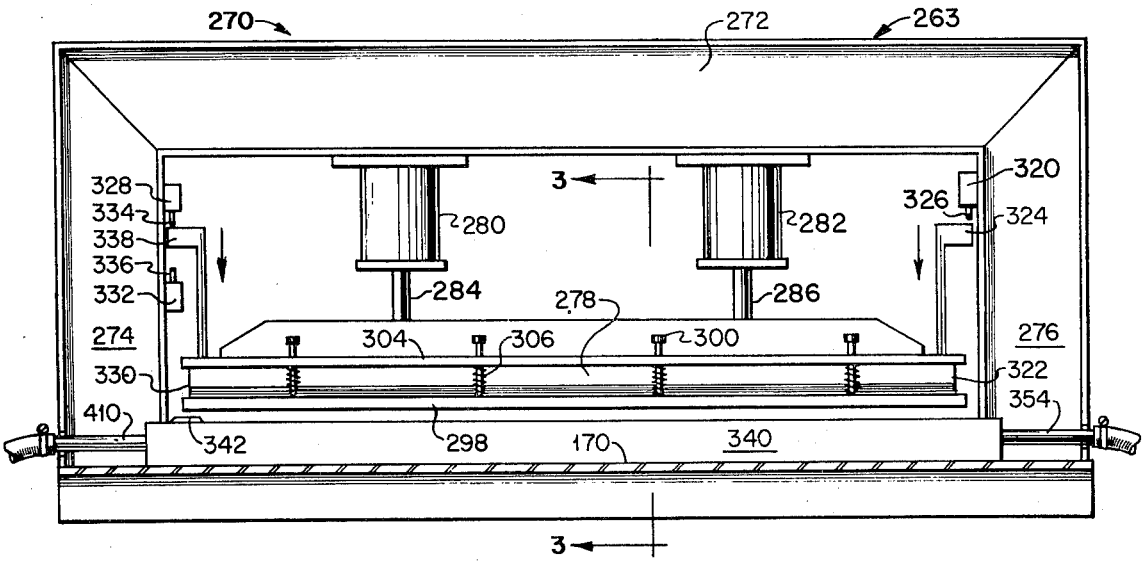
FIG. 4 is a fragmentary sectional view of a portion of the forward end of the apparatus depicted in FIG. 1.
Figure 16:
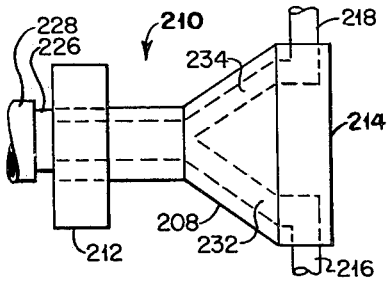
FIG. 16 is a representation of a rotary valve employed with the hole cutter depicted in FIG. 6.

FIGS. 2 and 2a depict a means for monitoring the lineal movement of the sheet material through the depicted apparatus and includes a metering wheel 430 rotatably mounted on the end 431 of an arm 432 whose opposite end 434 is pivotally hinged to the frame cross member 32 so that the metering wheel 430 may be moved along an arcuate path between positions of engagement and disengagement with sheet material wrapping the brake roll 74. The metering wheel is connected through a gear box 436 to a cam 438 such that rotation of the metering wheel effects rotation of the cam. The cam 438 is provided with a notch 440 in its periphery for receiving the switch arm 442 of an electric switch 444. Preferably the circumference of the wheel 430 is provided with a friction rim 446 to insure good driving contact between the wheel and the sheet material 50 as it moves over the roll 74 beneath the wheel. As will appear more fully hereinafter, when the sheet material is moved forwardly through the apparatus, the wheel 430, by reason of its frictional engagement with the sheet material, is caused to rotate. This rotation of the wheel is transferred through the gear box 436 to the cam 438 to rotate the cam. Because of the direct connection between the metering wheel and the cam, each rotation of the metering wheel effects a predetermined degree of rotation of the cam with the result that through choice of the length of the circumference of the metering wheel, a predetermined length of sheet material may be moved through the apparatus per each rotation of the cam. Each rotation of the cam brings the notch 440 into register with the arm 442 of the switch 444 to cause the switch to open and close in response to the rotational position of the notch.

With reference to the schematic control system depicted in FIG. 22, the switch 328 is connected by an electrical lead 450 to the solenoid valve 150, which controls the actuation of the braking and drive piston-cylinder 140, to provide an appropriate electrical signal to open the valve 150 when the arm 334 of the switch 328 is engaged by the contact 338, upon raising of the seal bar 278, thereby admitting pneumatic pressure to the piston-cylinder 140 to extend the piston 138 and rotate the rocker arms 92 and 94 to move the brake beam 72 out of engagement with the sheet material wrapping the brake roll 74 and, simultaneously, to move the friction drive roll 96 into engagement with the sheet material, thus commencing forward movement of the sheet material through the apparatus. The valve 150 is closed to shut off the piston-cylinder 140 from the source of pneumatic pressure and permit the piston 138 to return, under the influence of its spring bias, to its retracted position, when the seal arm 278 is lowered and the contact 338 disengages the arm 334 of the switch 328. This movement of the piston 138 results in movement of the rocker arms 92 and 94 to move the brake beam 72 to its engaged position and the friction drive roll 96 to its position of disengagement with the sheet material. Because the drive rolls continuously rotate, the sheet material immediately commences its forward movement when gripped in the nip 110 between the drive rolls upon the friction drive roll being moved to its position of engagement with the sheet material.

As noted above, the pneumatic pressure source 360 is further connected by a conduit 372, through the solenoid valve 392, to the piston-cylinder 390 which functions to rotate the central rotary member 382 of the rotary valve 358. This solenoid valve 392 is connected by electrical lead 460 to the switch 332 so that the electrical signal developed by this switch, when its arm 336 is contacted by reason of the seal bar 278 achieving its lowered position, is fed to the valve 392 to open the valve and admit pressurized air to the cylinder 390 and extend the piston 388 to move the pawl 386 into contact with the central rotary portion of the rotary valve 358 and rotate such central portion one-fourth of a turn. In a preferred embodiment, the cylinder 390 is connected to a closed container 462 of adjustable volume, thereby causing the pressure within the cylinder 390 to increase rapidly initially and thereafter more slowly due to the restricted exhaust of cylinder 390, with the result that the central rotary member 382 is turned first rapidly and then slowly through its one-fourth turn. This action provides for rapid movement of the central member 382 at the time of aligning one of its opening with an opening in the outlet member 384 thereby maximizing the rate of pressure rise in the channel 346 behind the block 344 to provide maximum propelling force to the block and the blade 342 carried thereon.

When the seal bar is raised the signal from the switch 332 to the valve 392 on piston-cylinder 390 is cut off causing this valve to close and exhaust the pressure from the piston-cylinder 390, thus retracting the pawl 386 to a position suitable for subsequent reengagement with the rotary valve 358.

Further, the electrical signal developed by the switch 444 when its arm 442 resides in the notch 440 of the cam 438 is fed by an electrical lead 464 to a timer 470, which provides a signal to a solenoid valve 466 to open this valve and admit pneumatic pressure, by conduits 463 and 465, simultaneously to the piston-cylinders 280 and 282 to lower the seal bar 278 against the sheet material disposed therebelow. When the timer 470 times out, it develops an electrical signal which serves to reverse the solenoid valve 466 and direct pneumatic pressure, by conduits 471 and 473, to the bottom ends 472 and 474 of piston-cylinders 280 and 282 to raise the seal bar.

When the seal bar reaches its upper position, the contact 324 on the bar engages the arm 326 of the switch 320 and develops an electrical signal that is fed to the timer 470 to reset the timer.

In an operation of the depicted apparatus embodying the disclosed method, the sheet material 50 is fed forwardly and downwardly from the supply roll 48 and wrapped around the dancer roll 52, thence upwardly and rearwardly to partially wrap the idler roll 70. From the idler roll, the sheet is fed forwardly in partially wrapping engagement with the brake roll 74, between the brake roll and the brake beam 72. From the brake roll, the sheet material is fed forwardly through the nip 110 between the friction drive roll 96 and the smooth surface drive roll 106, thence over the apron 152 and the top surface of the channel 346 to pass beneath the heat seal bar.

At the start of an operation of the disclosed apparatus, the friction drive roll 96 is in its upper position out of engagement with the sheet material, the heat seal bar 278 is in its upper position out of engagement with the sheet material, the brake beam 72 is engaged with the sheet material wrapping the brake roll 74, and the metering wheel 430 is positioned with its rim 446 engaging the sheet material wrapped about the brake roll. Also, the pneumatic pressure in the source 360 is established and the timer 470 is timed out.

Upon actuation of the apparatus by closing an appropriate switch 471, the control system of the apparatus is connected to a source of electrical power 297 and thereby energized, at the same time starting the motor 124, the motor 206, and the vacuum pump 222. The motors 124 and 206 and the vacuum pump 222 run continuously during the operation of the apparatus. Energizing the system with the seal bar 278 raised and the contact 338 engaging the arm 334 of the switch 328 functions to supply an electric signal appropriate to open the solenoid valve 150 to actuate the piston-cylinder 140 and move the friction drive roll 96 into engagement with the sheet material, while simultaneously raising the brake beam 72 and releasing the sheet material for movement through the apparatus.

As the sheet material moves through the apparatus, the metering wheel is rotated, resulting in rotation of the cam 438. After the desired length of sheet material has passed through the apparatus, the arm 442 of the switch 444 falls into the notch 440 on the cam to develop an electric signal which actuates the timer, hence the solenoid valve 466 to admit pneumatic pressure to the piston-cylinders 280 and 282 to lower the heat seal bar 278, and its flanking clamps 296 and 298, into engagement with the sheet material disposed beneath the heat seal bar. When the heat seal bar moves downward and the contact 338 disengages the arm 334 of the switch 328, the valve 150 closes and deactivates the piston-cylinder 140 to raise the friction drive roll out of engagement with the sheet material and lower the brake beam into engagement with the sheet material to stop forward movement of the sheet material through the apparatus.

As noted above, when the seal bar reaches its lowered position, the contact 338 actuates the switch 332 to develop a signal which actuates the valve 392 controlling the piston-cylinder 390 that turns the central rotating member 382 of the rotary valve 358 to admit pneumatic pressure to one end of the channel 346 to propel the cutoff knife along the length of the channel and sever the sheet material while it is stopped.

The signal from the switch 332 further serves to open the solenoid valve 262 to admit pneumatic pressure to the piston-cylinder 254 and move the cutting head 186 into position adjacent the top layer of the bilayered sheet material disposed on the top surface 170 of the slide beam 160. As noted hereinbefore, as the rotary cutting head moves into position adjacent the sheet material, it rotates the rotary valve 210 to apply suction to both the bottom and top layers of the sheet material disposed between the two vacuum heads. Upon the application of the suction, the bottom layer of the sheet material is pulled downwardly against the top surface 170 of the apron 152 and the top layer of the sheet material is pulled into engagement with the rotating cutting knife 188 to cause the knife to cut a circular plug from the top layer of the sheet material.

The timer 470 is set to time out after the heat seal bar has been in contact with the sheet material for a time sufficient to effect a heat seal of the top layer of the sheet material to the bottom layer. When the timer times out, it provides a signal to the solenoid valve 466 causing it to exhaust pneumatic pressure from the top ends of the piston-cylinders 280 and 282 and simultaneously admit pneumatic pressure to the bottom ends of these piston-cylinders to move the heat seal bar to its upper position out of engagement with the sheet material. This movement of the seal bar 278 disengages the contact 338 from the switch 332 to cut off the signal to the solenoid valve 262, causing this valve to close and exhaust the pneumatic pressure from the piston-cylinder 254 to raise the cutting head away from the sheet material. As the cutting head 186 is swung upwardly, it rotates the rotary valve 210 to sequentially close off the vacuum and momentarily admit pneumatic pressure through the central bore of the cutting knife 188 to expel the plug that was cut from the sheet material. The check valve 230 interposed in the conduit 228 functions to prevent the flow of pressurized air to the bottom vacuum port 182. As the cutting head is swung further upwardly, the rotary valve is turned to close off the pneumatic pressure source from the hollow knife 188.

Upon the heat seal bar 278 reaching its upper position, the contacts 234 and 338 engage the arms 326 and 334 of the switches 320 and 328, respectively, to reset the timer to open the valve 150 to admit pneumatic pressure to the piston-cylinder 140 for releasing the brake beam and moving the friction drive means into contact with the sheet material for commencing a further cycle of operation.

Each severed length 500 of tubular sheet material (see FIG. 1a), having one of its ends 502 sealed and provided with an opening 504 in one of its layers is manually removed from the apparatus to a subsequent processing station. As noted hereinbefore, each liner is fitted with an inflation valve. This inflation valve is put in place after the liner has been severed by the disclosed apparatus so that it is necessary that one end of each severed length of sheet material remain open to permit access to the inside of the liner for fitting the inflation valve in the liner. To this end, the disclosed apparatus provides for positioning the hole cutter 184 adjacent to the cut-off knife 340 and rearwardly therefrom to thus position the opening 504 a proper distance to the rear of the unsealed cut end 506 of each severed length of sheet material. Similiarly, the cut-off knife 340 is positioned rearwardly of the heat seal bar 278, between the hole cutter and the seal bar, to sever the sheet material across its width at a location rearwardly of and adjacent to the seal 508 across the sheet material.

Figure 1A:
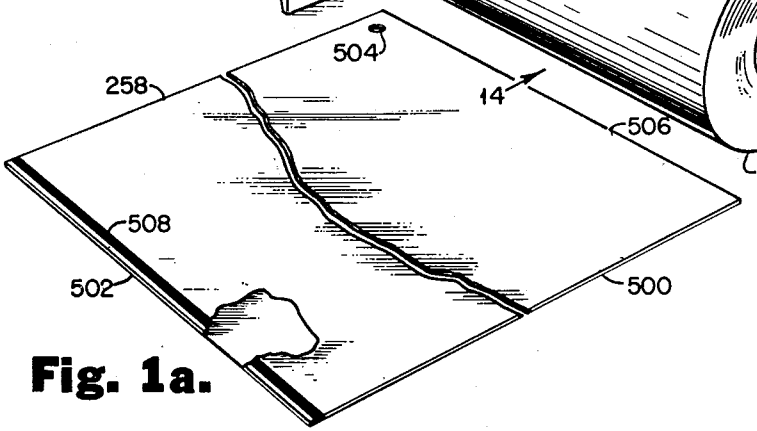

Liners, as depicted in FIG. 1a, are produced at a rapid rate, hence at a relatively low unit cost, employing the disclosed apparatus. By reason of the ability of the apparatus to rapidly move the bilayered sheet material through the apparatus without developing wrinkles in one or both layers and/or without buckling the sheet material, the length of each liner is precisely measured and the location of the hole for the inflation valve is precisely positioned. It has been found that the percentage of liners rejected due to apparatus failure, malfunction, etc. is essentially nil.

A further embodiment of means for providing a hole extending through the wall of the tubular sheet material is depicted in FIG. 23. In this depicted embodiment, a mounting block 509 is secured to the side member 28 of the frame 10 and extends outwardly from the frame to provide a sliding support for a plate slide 510 that is mounted on rods 512 and 514 residing in notches 516 and 518 on upstanding portions 520 and 522 of the mounting block 509. The bottom surface 524 of the slide 510 is provided with elongated slots that are hemispherical in cross-section into which the rods 512 and 514 are received to mount the slide for longitudinal movement in a direction transversely to the movement of the tubular sheet material 50 through the apparatus.

Movement of the slide 510 in such transverse direction is accomplished by means of a double-acting hydraulic piston cylinder means 526, the cylinder member 528 of which is mounted on the block 509 such that its piston member 530 extends toward the tubular material 50 and is releasably received in a clamping block 532 that depends from the bottom surface 524 of the slide 510. Upon actuation of the piston-cylinder 526, retraction or extension of the piston member 530 thereby functions to move the slide 510 transversely of the forward direction of movement of the tubular material 50, that is, it moves the slide laterally relative to the forwardly moving tubular material. The opposite ends 536 and 538 of the cylinder 526 are connected by means of conduits 540 and 542 through a valve 544 to a source of hydraulic pressure 546 so that extension or retraction of the piston 530 within the cylinder 526 is accomplished by the selective introduction of pressurized hydraulic fluid to one or the other of the ends of the cylinder.

On the upper surface 548 of the slide 510, there is mounted a sensor head 550, which in the depicted embodiment comprises a bifricated yoke 552, one leg 554 of which is disposed above the upper surface 556 of the tubular sheet material 50 and the other leg 558 which is disposed the bottom side of the tubular material. The depicted sensing head is of conventional design which employs orifices (not shown) disposed in opposing relation in the two legs of the yoke such that the flow of air between the orifices is affected by the interposition of the tubular material between the orifices. This air flow through these orifices is accomplished by means of a first conduit 560 and a second conduit 562 that lead from the valve 544 and provide air flow to the valve for controlling the movement of the valve spool as is well known in the art, to selectively admit pressurized hydraulic fluid to one or the other of the ends of the cylinder 526. In this manner, the sensing head 550 senses the lateral position of the edge 564 of the moving tubular material to develop a signal that is fed back to the piston-cylinder 526 to move the slide 510 laterally in a manner that causes the slide 510 to remain at a fixed distance from the edge 564 of the moving tubular material. In normal operations, a variation of ⅛ inch or less is encountered so that it will be recognized that relatively small movements are involved in this positioning operation.

Also mounted on the upper surface 548 of the slide 510 is a punch 566 comprising an anvil plate 568 and a single acting piston-cylinder means 570 mounted in cantilevered fashion on the slide and extending to a position below the edge of the moving tubular material. A right-cylindrical punch 572 is attached to the piston 574 of the piston-cylinder 570 and is disposed generally vertically over the edge 564 of the tubular material above the anvil plate 568. Although not visible in the depicted embodiment, the anvil plate 568 is provided with a circular opening beneath the punch 572 and through which the punch travels upon extension of the piston 574, thereby punching an opening in the tubular material disposed between the punch and the anvil. In the depicted embodiment, the sensing head 550 positions the slide 510 relative to the edge of the moving tubular material such that the edge of the moving material is disposed along the diameter of the punch 572. In this manner, upon actuation of the piston and resultant downward movement of the punch, there is punched a semicircular section from the folded edge 564 of the tubular material 50. It will be understood that when the tubular material is flattened at this location, there will be a circular opening through the wall of the tubular material.

Actuation of the piston-cylinder means 570 to extend the piston 574 and the punch 572 is effected by an electrical signal emanating from the electrical power source 297, through a switch 471, and a further switch 332 as referred to hereinbefore in connection with operation of the hole cutter 184. In the depicted embodiment, the piston 574 is biased toward its retracted position within the cylinder 578. Pneumatic pressure from a source 580 is conducted by a conduit 582 to the end 584 of the cylinder 570 through a solenoid valve 586 to provide a power source for driving the punch 572. It will be recognized that minor modifications in the apparatus of this embodiment may be affected while still accomplishing the desired result of severing a semi-circular portion from the folded edge 564 of the tubular material 50.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed:

1. In a method for the manufacture of inflatable liners of discrete length for dunnage bags or the like from a continuous length of air-impervious tubular material flattened into sheet form comprising top and bottom layers, the steps of storing said sheet material in position for dispensing in a forward direction, disposing the leading end of said material in the nip between a pair of feed rolls, at least one of which is movable between positions of pressure engagement and disengagement with said material in said nip, connecting said feed rolls in driving relationship to one another and continuously rotating said rolls at all times during the manufacture of said liners, moving said movable roll into pressure engagement with said material in said nip, rotating at least one of said feed rolls to move said material forwardly to a cut-off station where said material is disposed proximate to a knife means, supporting said material transverse to its forward movement at a location between its storage location and said feed rolls in engagement with an elognated surface and below an elongated friction means aligned with said elongated surface and which is movable between positions of pressure engagement and disengagement with said material on said elongated surface, after a predetermined length of said material has moved past said cut-off station, simultaneously moving said movable feed roll toward its position of disengagement with said material, moving said movable friction means toward its position of engagement with said material to stop the forward movement thereof, clamping said material between opposed surfaces along elongated spaced apart locations on opposite sides of said knife means, each of said locations extending transversely of he forward direction of movement of said material, thereafter severing said material fully across its dimension transverse to its direction of forward movement, and sealing to one another the layers of the trailing end of the severed length of material along a line extending fully across the material transversely of its direction of forward movement.

2. The method of claim 1 including the steps of positioning a cutter means over said stopped material adjacent to the leading end of said material upstream of said cut-off station and inwardly from one side margin of said sheet material, applying suction to the bottom one of said layers of said material to urge said material downwardly, applying suction to the top one of said layers of said material to pull said layer upwardly away from said bottom layer and simultaneously urge said top layer into engagement with said cutter means to cut a plug from said top layer and provide an opening through the thickness thereof.

3. The method of claim 1 and including the step of opening a hole through the wall of said material.

4. The method of claim 3 wherein said hole is opened by severing a semicircular section from the side edge of said material.

5. The method of claim 2 including the steps of sequentially commencing withdrawal of said cutter from its position over said top layer, releasing said suction to said top and bottom layers, and applying pressure to expel said plug from said cutter.

* * * * *